US007589266B2

(12) United States Patent
Richter

(10) Patent No.: US 7,589,266 B2
(45) Date of Patent: Sep. 15, 2009

(54) MUSICAL INSTRUMENT STRING

(75) Inventor: Jacob Richter, Ramat Hasharon (IL)

(73) Assignee: Zuli Holdings, Ltd., Tel Aviv (IL)

( * ) Notice: Subject to any disclaimer, the term of this patent is extended or adjusted under 35 U.S.C. 154(b) by 0 days.

(21) Appl. No.: 11/465,917

(22) Filed: Aug. 21, 2006

(65) Prior Publication Data

US 2008/0041213 A1 Feb. 21, 2008

(51) Int. Cl.
*G10D 3/10* (2006.01)

(52) U.S. Cl. ..... 84/297 S; 84/297 R

(58) Field of Classification Search ..... 84/297 R, 84/297 S

See application file for complete search history.

(56) References Cited

U.S. PATENT DOCUMENTS

| | | | | |
|---|---|---|---|---|
| 2,535,143 | A | 12/1950 | Kosmis | |
| 2,710,557 | A | 6/1955 | Sundt | |
| 3,605,544 | A | 9/1971 | Kondo | |
| 3,753,797 | A | 8/1973 | Fukuda | |
| 3,856,513 | A | 12/1974 | Chen et al. | |
| 4,063,674 | A | 12/1977 | Stone et al. | |
| 4,184,405 | A | 1/1980 | How | |
| 4,339,499 | A | 7/1982 | Tappe et al. | |
| 4,382,358 | A | 5/1983 | Tappe et al. | |
| 4,400,208 | A | 8/1983 | Ackermann | |
| 4,473,401 | A | 9/1984 | Masumoto et al. | |
| 4,501,186 | A * | 2/1985 | Ikuma | 84/726 |
| 4,523,626 | A | 6/1985 | Masumoto et al. | |
| 4,527,614 | A | 7/1985 | Masumoto et al. | |
| 4,557,766 | A | 12/1985 | Tenhover et al. | |
| 4,578,123 | A | 3/1986 | Schultz et al. | |
| 4,584,034 | A | 4/1986 | Hagiwara et al. | |
| 4,607,683 | A | 8/1986 | Hamashima et al. | |
| 4,609,442 | A | 9/1986 | Tenhover et al. | |
| 4,735,864 | A | 4/1988 | Masumoto et al. | |
| 4,762,677 | A | 8/1988 | Dolgin | |
| 4,781,771 | A | 11/1988 | Masumoto et al. | |
| 4,806,179 | A | 2/1989 | Hagiwara et al. | |
| 4,833,027 | A | 5/1989 | Ueba et al. | |
| 4,854,213 | A | 8/1989 | Infeld | |
| 5,000,251 | A | 3/1991 | Bijaoui et al. | |
| 5,288,344 | A | 2/1994 | Peker et al. | |
| 5,312,495 | A | 5/1994 | Masumoto et al. | |
| 5,368,659 | A | 11/1994 | Peker et al. | |
| 5,427,008 | A | 6/1995 | Ueba et al. | |
| 5,547,487 | A | 8/1996 | Blum et al. | |
| 5,554,232 | A | 9/1996 | Fujimoto et al. | |
| 5,578,775 | A * | 11/1996 | Ito | 84/297 S |
| 5,587,541 | A | 12/1996 | McIntosh et al. | |
| 5,772,803 | A | 6/1998 | Peker et al. | |
| 5,807,613 | A * | 9/1998 | Aguero et al. | 427/528 |
| 6,057,498 | A * | 5/2000 | Barney | 84/199 |
| 6,348,646 | B1 * | 2/2002 | Parker et al. | 84/297 R |
| 6,580,021 | B2 | 6/2003 | Barney | |
| 6,685,577 | B1 | 2/2004 | Scruggs et al. | |
| 6,695,936 | B2 | 2/2004 | Johnson | |
| 7,017,645 | B2 | 3/2006 | Johnson et al. | |
| 2005/0034792 | A1 | 2/2005 | Lu et al. | |
| 2006/0076089 | A1 | 4/2006 | Chang et al. | |

FOREIGN PATENT DOCUMENTS

| | | | | |
|---|---|---|---|---|
| JP | 54076423 A * | 6/1979 | | 84/287 S |
| JP | 61-114297 | 5/1986 | | |

OTHER PUBLICATIONS

"*Glassy Steel*," Oak Ridge Nat'l Lab. Rev., at http://www.ornl.gov/info/ornlreview/v38_1_05/article17.shtml (last visited Sep. 28, 2006).

Fariss Samarrai, "*Stronger Than Steel*," Oscar: scholarship, creativity and research at U.Va., at http://www.oscar.virginia.edu/x5703.xml (last visited Sep. 28, 2006).

Catherine Zandonella, "A Drop of the Hard Stuff," NewScientist, pp. 35-37 (Apr. 2005).

Davide Castel Vecchi, "*Glass-Like Metal Performs Better Under Stress*," Phys. Rev. Lett. 94, 205502 (Jun. 9, 2005), available at http://focus.aps.org/story/v15/st20.

Liquidmetal Technologies, Our Technology, at http://www.liquidmetal.com/technology/default.asp (last visited Sep. 28, 2006).

Liquidmetal, Sporting Goods and Leisure Products, at http://www.liquidmetal.com/applications/dsp.sporting.asp. (last visited Sep. 28, 2006).

DeTemple Pure Titanium Components, Frequently Asked Questions (FAQs), at http://www.detempleguitars.com/pages/faqs/faqs04.htm (last visited Sep. 28, 2006).

(Continued)

*Primary Examiner*—Kimberly R Lockett
(74) *Attorney, Agent, or Firm*—Cadwalader, Wickersham & Taft, LLP

(57) ABSTRACT

An improved string for a musical instrument comprising amorphous metal is disclosed. The string may be a single wire of amorphous metal or comprise a core wire and covering wire, wherein the core wire and/or covering wire comprises amorphous metal. Such a string has greater sustain of sound and higher volume of sound over a longer period of use than previously available metal strings. Musical instruments comprising such strings are also disclosed.

9 Claims, No Drawings

OTHER PUBLICATIONS

John William Strutt, The Theory of Sound 297-98 (MacMillan & Co., Ltd. 1926) (1877).
Neville Fletcher, "*Damping of Strings* (*Abstract*)," University of New England, Armidale, Australia (supplied by The British Library—the world's knowledge).
G. Bellessa, "*Sound Propogation In Amorphous Co-P*," J. Phys. C: Solid State Phys., vol. 10, (Mar. 1977).
Liebermann et al., "*Technology of Amorphous Alloys*," Chemtech, pp. 363-367 (Jun. 1987).
Schroeder et al., "*Comparison of the Corrosion Behavior of a Bulk Amorphous Metal,* $Zr_{41.2}Ti_{13.8}Cu_{12.5}Ni_{10}Be_{22.5}$ *With Its Crystallized Form*," Scripta Materialia, vol. 38, No. 10, pp. 1481-1485, Elsevier Science Ltd. (Acta Metallurgica Inc. 1998), available at http://www.lbl.gov/Ritchie/Library/PDF/9800089x.pdf.
Ahn et al., BE309 Final Project: Vibration Analysis of a Sinusoidally Driven System, available at http://www.seas.upenn.edu/courses/belab/LabProjects/1998/BE309F98T1R01.htm (follow "Full Text" hyperlink).
Steven Ashley, "*Metallic Glasses Bulk Up*," Mech. Eng'g (Jun. 1998), available at http://web.archive.org/web/20041101042951/http://www.memagazine.org/backissues/june98/features/metallic.html (last visited Sep. 28, 2006).
Richard Ward, "*Find Your Sound: Whether You Prefer Gut, Steel of Synthetic, There's A Violin String That's Right For You*," Strings, No. 95 (Jul. 2001), available at http://www.stringsmagazine.com/issues/strings95/coverstory.shtml.
Erik Jansson, "*Acoustics for Violin And Guitar Makers, Chapter VI: Properties of the Violin and the Guitar String*," Kungl Tekniska Hogskolan, Dept. of Speech, Music and Hearing (4th ed. 2002), available at http://www.speech.kth.se/music/acviguit4/part4.pdf.
Michael Rogers, "*The Tao of Strings*," Caltech News, vol. 37, No. 4 (2003), at http://pr.caltech.edu/periodicals/CaltechNews/articles/v37/strings.html (last visited Sep. 28, 2006).
Srikanth et al., "*Effect of Milling on the Damping Behavior of Nano-Structured Copper*," National University of Singapore, Dept. of Mech. Eng'g.
Schewe et al., "Amorphous Steel," Physics News Update, Jun. 21, 2004, available at http://www.aip.org/pnu/2004/split/689-2.html.
Press Release, Carnegie Mellon Media Relations, New Computational Method Developed By Carnegie Mellon University Physicist Could Speed Design and Testing of Metallic Glass.
Notification Concerning Transmittal of Copy of International Preliminary Report on Patentability dated Mar. 26, 2009, 7 pages, from corresponding application No.: PCT/IB2007/002361.
Notification of Transmittal of the International Search Report and the Written Opinion of the International Searching Authority, or the Declaration dated Nov. 10, 2008, 8 pages, from corresponding application No.: PCT/IB2007/002361.

* cited by examiner

MUSICAL INSTRUMENT STRING

FIELD OF INVENTION

The present invention relates to a string for a musical instrument comprising amorphous metal and, more particularly, to a string for a musical instrument having a longer lifetime and a greater sustain of vibration and higher volume of sound for a given initiated amplitude over a longer period of use.

BACKGROUND OF THE INVENTION

The material science of musical instrument strings has developed significantly over the past century and today strings are made from a variety of materials in order to suit a diverse spectrum of consumer preferences regarding tone quality and playability. Acoustic guitars, violins, violas, cellos and acoustic basses are traditionally strung with materials having relatively low elasticity, such as natural gut, nylon and other synthetic resins, which are used to achieve certain desired sound qualities and playability. Although gut strings have long been used on musical instruments and favored by many, they often exhibit non-uniform qualities, experience fluctuations in tensile strength due to adsorption of moisture and tend to deteriorate rapidly when exposed to changes in temperature and humidity. Nylon has gained wide acceptance as a substitute for gut strings and has the advantage of being manufactured with consistency and considerably more durability. Similar to gut strings, however, nylon is also sensitive to changes in humidity and suffers a significant loss of tension over time. Still other synthetic materials have been suggested for use in musical instruments. For example, U.S. Pat. Nos. 4,339,499 and 4,382,358 to Tappe et al. and U.S. Pat. Nos. 4,833,027 and 5,427,008 to Ueba et al. disclose the use of a polyvinylidene fluoride material, U.S. Pat. No. 4,854,213 to Infeld teaches a musical instrument string comprised of aromatic polyamides, U.S. Pat. No. 5,587,541 to McIntosh et al. claims the use of thermoplastic aromatic polyetherketone and Japanese Patent 61114297 describes music strings made of drawn polyacetal. Other musical instruments, such as pianos, electric guitars and electric basses, typically employ strings constructed of less compliant materials having relatively high elasticity, such as carbon steel wire, stainless steel wire or phosphor bronze wire.

One of the most sought after features among musicians today is a musical instrument string that sustains its vibration and exhibits a higher volume of sound over a longer period of use. These characteristics depend largely upon the internal damping properties of the material used. A string with significantly low internal damping allows a majority of the wave motion created by the string vibration to be transferred to the body of the musical instrument without being absorbed by the string. This quality is particularly favorable in acoustic instruments, providing improved resonance within the body of the instrument. In other words, a low degree of material damping in a musical instrument string prevents the vibrations of the string from decaying too quickly and creating a "flat" or "dull" sound. In other words, reductions in internal damping leads to more sustained harmonics and therefore a brighter and more lively string sound.

Gut, nylon and synthetic resin materials typically exhibit high degrees of damping, due largely to the visco-elastic behavior of these materials. Some attempts have been made to reduce the internal damping of nylon strings by various treatments. For example, U.S. Pat. No. 3,842,705 describes the use of irradiation by high intensity ionizing radiation to improve the playing quality of nylon strings and U.S. Pat. No. 4,015,133 describes the use of radiation to improve the elasticity and reduce the damping in polyamide strings. These treatments, however, require the use of radioactive sources or high intensity electron beams and are expensive and technically difficult to carry out.

Metal strings, on the other hand, have much lower visco-elasticity and possess much better damping characteristics. Nonetheless, conventional metal strings are limited in their ability to achieve sustained vibration and higher volumes of sound due to the crystalline structure and its inherent imperfections, which absorbs mechanical energy. In addition, the bright tone and sustain of metal strings is typically short-lived once the strings have been installed on the instrument. That is, after being tuned to a desired pitch and played, the tone or sound produced by the string gradually diminishes in brilliance until reaching a flat or "dead" quality. This is particular prevalent in wound metal strings, where debris and corrosion quickly build up between the windings.

Accordingly, it is an object of the invention to provide a musical instrument string having improved sustain of vibration as a result of decreased internal damping. Another object of the invention relates to a metal string having an improved lifespan and a reduced adsorption of energy that results in a longer and higher volume of sound for a given amplitude of perturbation by a bow in a string instrument or a hammer in a piano-like instrument.

SUMMARY OF THE INVENTION

The invention provides a musical instrument string which sustains a vibration and produces a higher volume of sound than conventional strings. Generally, the string of the invention contains an amorphous metal or an amorphous metal alloy. The music instrument string may be used on a variety of musical instruments and is characterized by low internal damping, high tensile strength and low elasticity, providing a greater sustain of vibration and longer, higher volume of sound over the life of the string.

A still further aspect of the invention relates to a musical instrument string having a greater sustain of vibration than a string of identical dimension comprising a crystalline structure as measured by the ratio of the decay time of the fifth harmonic to the decay time of the fundamental frequency. The ratio of the decay time of the fifth harmonic to the decay time of the fundamental frequency may be greater than 0.55. In addition, the string of the invention may also exhibit a second harmonic amplitude that is greater than the amplitude of the fundamental frequency of the string.

The present invention also comprises a musical instrument having one or more strings of the invention.

DETAILED DESCRIPTION OF THE INVENTION

The present invention is directed to an improved string for a musical instrument having at least one amorphous metal or alloy thereof. As used herein, the term "amorphous metal" means a metallic material having a non-crystalline structure and highly disordered atomic arrangement and includes amorphous metallic alloy compositions consisting of more than one material as well as an amorphous metallic material of a single metal. Amorphous metals are commonly referred to as glassy alloys, non-crystalline-alloys or metallic glasses and are made using a variety of techniques, all of which involve rapid solidification of the metal constituents from a gas or liquid phase. The solidification occurs so rapidly that atoms become frozen in their liquid configuration and, thus, lack long-range atomic order characteristic of conventional crystalline metals.

In accordance with the present invention, the use of an amorphous metal in a musical instrument string offers surprising and unexpected advantages over those conventional metals, metallic composites and non-metallic compositions traditionally used in musical instrument strings. Amorphous metal possesses high tensile strength—up to tenfold higher than that of conventional musical instrument string metals such as carbon steel or stainless steel and has a tenfold wider elastic range. In addition, the lack of imperfections inherent in crystalline materials provides for improved damping characteristics over a longer period of use. More specifically, conventional metals are characterized by a highly-ordered arrangement of atoms, commonly termed a "crystalline" or "crystalline lattice" structure.

In a conventional musical instrument string, the vibratory energy of a conventional metal string is absorbed and dissipated by the movement of the dislocations and grain boundaries present in the crystalline structure. The movement and subsequent growth of dislocations within a conventional metal string as the string is repeatedly set into motion impedes the movement of the crystals within the crystalline structure and, consequently, inhibits the ability of the string to sustain a vibratory motion. Furthermore, the interaction between the grain boundaries of adjacent crystals within a conventional metal string causes internal friction and effectively converts vibratory energy into heat, decreasing the amplitude and overall resonance of the string. At bottom, the crystalline structure of a conventional metal absorbs mechanical energy, whether it be from a pluck, strum or bow, and dampens both the sustain and overall volume produced by a vibrating string.

A musical instrument string having amorphous metal exhibits improved damping characteristics and increased mechanical energy attributable to the lack of atomic alignment within the amorphous structure. Absent from an amorphous metal are those imperfections inherently present in the crystalline lattice structure of a conventional metal that create friction and lead to the absorption, rather than transfer, of energy. In turn, the vibrational motion of the string maintains a higher level of energy for a longer period of use. As a result, the pitch produced by a musical instrument string containing amorphous metal is brighter, louder and more sustained than those musical instrument strings made of conventional materials.

In accordance with the invention, the musical instrument string may contain a solid wire of amorphous metal or a stranded wire comprised of multiple filaments bundled, twisted, rolled, braided or otherwise joined together. The stranded wire may consist entirely of amorphous metal filaments (either identical or different) or include a combination of amorphous metal filaments and one or more other materials suitable for achieving the objectives of the invention. The musical instrument string of the invention may be either a single string or a wound string. A single string may be a solid wire or a stranded wire. A wound string may consist of a core wire and a covering wire, the covering wire being wrapped around the core wire to provide a musical instrument string with a larger diameter but retained flexibility. The core wire and covering wire may be solid or stranded and made of amorphous metal alone or in combination with other suitable materials, including without limitation, gut, synthetic material, aluminum, nickel and steel.

One embodiment of the invention provides a string for a musical instrument containing amorphous metal, wherein the amorphous metal may specifically contain one or more of the following metals: iron (Fe), nickel (Ni), titanium (Ti), aluminum (Al), chromium (Cr), cobalt (Co), zirconium (Zr), copper (Cu), beryllium (Be), hafnium (Hf), molybdenum (Mo) or manganese (Mn). More generally, the amorphous metal may contain (Fe).

In another embodiment of the invention, the string may contain an amorphous metal alloy. The amorphous metal alloy composition may include one or more of the following metalloids: silicon (Si), boron (B), germanium (Ge) or tellurium (Te), one or more non-metals or one or more rare earth metals.

In one embodiment, the musical instrument string contains an amorphous metal alloy the following: iron (Fe), chromium (Cr), manganese (Mn), molybdenum (Mo), carbon (C) and boron (B). In a related aspect, the string may include yttrium (Y) and/or may have the following atomic percentages: iron (Fe) (≦40%), chromium (Cr) (<25%), manganese (Mn) (15%-25%), molybdenum (Mo) (<25%), carbon (C) (10%-25%), boron (B) (10%-25%) and yttrium (Y) (≦4%).

Another embodiment of the musical instrument string has an amorphous metal alloy of one or more of the following metals: iron (Fe), nickel (Ni), titanium (Ti), aluminum (Al), chromium (Cr), cobalt (Co), zirconium (Zr), copper (Cu), beryllium (Be), hafnium (Hf), molybdenum (Mo) or manganese (Mn).

The musical instrument string of the invention may be placed on a variety of musical instruments that require strings, including but not limited to, violins, guitars, pianos, basses, cellos and violas. On instruments with fretboards, such as violins, guitars, basses, cellos and violas, one end of the string contains a conventional securing feature comprised of a metal eyelet or ball or simply the material itself tied in a knot. The securing feature is slipped into a slot in the tailpiece, fixing the end of the string to the musical instrument. The other end of the string is fed through the nut on the headstock of the instrument and subsequently wound onto a tuning pin also located on the headstock. The strings are placed under tension by turning the tuning pin. Certain instruments, such as a violin, acoustic bass, cello and viola, also have a bridge, the location and height of which determine the distance of the strings from the fretboard. The bridge supports the strings and keeps them from contacting the fretboard when the strings are tensioned. In a piano, each string is fixed or grounded at one end by a hitch pin located on the bowed portion of the piano harp and, at the other end, by an adjustable tuning pin frictionally and rotatably retained in a tuning block. The strings are placed under tension by turning and adjusting the tuning pin.

The core wire and covering wire may have a wide range of diameters that achieve the objectives of the invention. The string of the present invention may preferably have a diameter between about 0.005 inches and about 0.350 inches. Further, the string may be tensioned from about 0.500 pounds to about 450 pounds. For use on a violin, the musical instrument string may have diameters between about 0.009 inches and about 0.036 inches and be tensioned from about 7.81 lbs. to about 19 lbs. For use on an electric guitar, the musical instrument string may have a diameter between about 0.008 inches and about 0.084 inches and be tensioned from about 9.1 lbs. to about 39.0 lbs. For use on an acoustic guitar, the musical instrument string may have a diameter between about 0.009 and about 0.056 and be tensioned from about 12.9 lbs. to about 34.8 lbs. For use on an electric bass, the musical instrument string may have a diameter between about 0.018 inches and about 0.135 inches and be tensioned from about 30 lbs. to about 67 lbs. For use on an acoustic bass, the musical instrument string may have a diameter between about 0.046 inches and about 0.149 inches and be tensioned and from about 39 lbs. to about 75 lbs. If the musical instrument string is used on a piano, the strings may have diameters as large as 0.350 inches and be tensioned up to at least 450 lbs. It will be appreciated, however, that the musical instrument string may have any diameter or be strung to any tension on any instrument so long as the objectives of the invention, as set forth herein, are achieved.

Several methods exists to demonstrate superiority of the strings of the present invention as compared to conventional strings. For example, the strings of the present invention have a modulus of elasticity greater than strings made of gut or nylon so as to avoid damping properties characteristic of highly visco-elastic materials. In addition, strings of the present invention have a lower modulus of elasticity than that found in conventional metal strings, and the strings of the invention have a greater sustain of vibration and a higher volume of sound. The following table shows Young's modulus of elasticity and the material density for a variety of materials conventionally used in musical instrument strings:

| Material | Modulus of Elasticity (GPa) | Material Density (Kg/m$^3$) |
|---|---|---|
| Steel | ~200 | 7,800 |
| Gut | 5-6 | 1,300 |
| Nylon | 2-4 | 1,200 |
| Aluminum | 69 | 2,700 |
| Nitinol | 83 (austenite)<br>28-41 (martensite) | ~6,400 |
| Nickel | 214 | 8,900 |
| Iron | 196 | 6,980 |
| Copper | 124 | 8,900 |

Improved reduction of damping may be achieved by selecting an amorphous metal alloy having the combination of a modulus of elasticity between 60 GPa and 150 GPa and a material density between 2,700 kg/m$^3$ and 7,000 kg/m$^3$. For example, a musical string containing an amorphous metal having a modulus of elasticity less than 150 GPa is encompassed by the instant invention. Similarly, a string containing an amorphous metal having a material density between about 2,000 kg/m$^3$ and about 8,000 kg/m$^3$ also falls within the scope of the invention. In like fashion, the amorphous metal may have a material density between about 2,000 kg/m$^3$ and about 8,000 kg/m$^3$ and/or a modulus of elasticity less than 75 GPa or less than 150 GPa. The musical instrument string may have any modulus of elasticity and/or material density so long as the string functions in accordance with the objectives of the invention.

One known method for determining whether the material properties of the amorphous metal containing string produce improved reduction of damping is to compare the decay time of the fifth harmonic to the decay time of the fundamental frequency. This ratio may also be compared to a similar ratio obtained from a crystalline metal musical instrument string of identical composition and dimension. Preferably, the ratio of the amorphous metal string is greater than that of the conventional metal string of identical composition and dimension. A method for obtaining such data is described in U.S. Pat. No. 5,587,541 to McIntosh et al., which is incorporated herein by reference. More specifically, conventional metal strings exhibit a ratio of decay time of the fifth harmonic to the decay time of the fundamental frequency of approximately 0.45. In one embodiment, the musical instrument strings have a ratio greater than 0.55.

It is also known that the increased amplitude of the second harmonic relative to the fundamental gives a brighter sound. The present invention contemplates that the ratio of the amplitude of the second harmonic to the amplitude of the fundamental frequency of the string is greater than the ratio of the amplitude of the second harmonic to the amplitude of the fundamental frequency of a conventional crystalline metal string.

Thus, another embodiment relates to a musical instrument string having a greater sustain of vibration than a string of identical dimension comprising a crystalline structure as measured by the ratio of the decay time of the fifth harmonic to the decay time of the fundamental frequency. The ratio of the decay time of the fifth harmonic to the decay time of the fundamental frequency may be greater than 0.55. In addition, the string of the invention may also exhibit a second harmonic amplitude that is greater than the amplitude of the fundamental frequency of the string.

The strings according to the present invention can be manufactured by a number of methods known in the art. Amorphous metal wire filaments having circular cross-sections may be produced, for example, by methods described in U.S. Pat. Nos. 4,781,771 and 4,735,864, which are incorporated herein by reference.

The invention employs, but is not limited to, the use of wire filaments of Fe-based and Co-based amorphous metal alloys. These particular alloys are known in the art to have excellent wire-forming ability in comparison to other amorphous metal alloys.

One method of obtaining amorphous metal wire filaments of circular cross-section is to extrude, roll or draw the ribbon produced by conventional rapid-quenching processes. See, e.g., U.S. Pat. No. 3,865,513 (incorporated herein by reference). Alternatively, the circular cross-sections may be obtained using the "in-rotating-water spinning method," as described in U.S. Pat. No. 4,523,626 (Fe-based amorphous metal wire filaments with circular cross-section) or U.S. Pat. No. 4,527,614, which are incorporated herein by reference.

In this method, a cooling liquid is introduced into a rotary drum and a cooling liquid film is formed on the inner wall of the drum by centrifugal force. The molten alloy is injected into the cooling liquid film from a spinning nozzle to initiate quenching. To obtain a continuous wire having a high degree of roundness and a little unevenness in wire diameter, it is preferable to adjust the peripheral velocity of the rotary drum to exceed the velocity of the stream of the molten metal injected from the spinning nozzle by about 5% to about 30% and to adjust the angle between the stream of the molten metal being injected from the spinning nozzle and the cooling liquid film formed on the inner wall of the drum to about 20° to about 70°. Alternatively, U.S. Pat. No. 5,000,251, which is incorporated herein by reference, discloses a method whereby the jet of molten metal contacts a gaseous atmosphere before contacting the cooling liquid.

Amorphous metal wire filaments of the present invention can also be produced by a so-called "conveyor method, " as described in U.S. Pat. No. 4,607,683, incorporated herein by reference. In this method, a molten metal is injected from a spinning nozzle and placed in contact with a cooling liquid layer formed on a running, grooved conveyor belt to quench the same.

The methods for producing amorphous metal wire filaments have improved in cold workability and the production of such fine wires of amorphous metal having good fatigue characteristics and high toughness is known in the art. For example, U.S. Pat. No. 4,806,179 (incorporated herein by reference) discloses an amorphous alloy having a specified Fe—Co—Cr—Si—B composition which exhibits sufficient toughness during working operations. These characteristics are particularly advantageous and provide an amorphous metal which can be bundled, twisted, rolled, braided or otherwise joined together to produce a stranded wire. The amorphous metal wire of the invention exhibits good fatigue characteristics and high toughness and may also be continuously cold-drawn using conventional metal wire-drawing processes without breaking. By using a number of dies, the wire can be drawn until a desired wire diameter is achieved.

In addition to the above described methods of producing amorphous metals and metal alloys, other methods are equally useful and are known to the skilled artisan. Examples include but are not limited to methods described in U.S. Pat. Nos. 3,865,513, 5,288,344, 5,368,659, 5,618,359 and 5,735,975, and U.S. Patent App. Pub. No. 2005/0034792, which are incorporated herein by reference. Methods of forming bulk amorphous metal alloys having large cross-section diameters include suction casting, melt spinning, planar blow casting and conventional die casting and are also known in the art.

In one embodiment, the musical instrument string comprises bulk amorphous steel. The composition of the bulk amorphous steel may include iron, chromium, manganese, molybdenum, carbon and boron. One such composition is available commercially under the trade name DARVA-Glass 1. The composition of bulk amorphous steel may also include iron, chromium, manganese, molybdenum, carbon, boron and a rare earth element, such as yttrium. The addition of yttrium causes destabilization of the competing crystal structure and enables the alloy to remain in a "liquid-like" structure at very low temperatures and thus stay amorphous as it solidifies. The yttrium is believed to also retard the growth of iron carbide crystals, making the steel less likely to become crystalline. One such composition is available commercially under the trade name DARVA-Glass 101 and exhibits hardness and strength more than double that of conventional steel and is about one third of the weight of conventional steel. Similar iron-based bulk amorphous metals having enhanced glass-forming ability are disclosed in U.S. Patent App. Pub. No. 2005/0034792, which is incorporated herein by reference.

The musical instrument string may also be a zirconium-titanium-nickel-copper-beryllium alloy. In this embodiment, the bulk-solidifying amorphous alloy has a glass-transition temperature between about 350° C. and about 400° C. and a fluid temperature between about 700° C. and about 800° C. This embodiment may have an atomic percentage of about 41.2 percent zirconium, 13.8 percent titanium, 10 percent nickel, 12.5 percent copper and 22.5 percent beryllium, and is described in U.S. Pat. No. 5,288,344, which is incorporated herein by reference.

The musical instrument string may also be composed of from about 25% to about 85% total of zirconium (Zr) and hafnium (Hf), from about 5% to about 35% aluminum (Al) and from about 5% to about 70% total of nickel (Ni), copper (Cu), iron (Fe), cobalt (Co) and manganese (Mn), plus incidental impurities, the total of the percentages being 100 atomic percent. U.S. Patent App. Pub. No. 2006/0076089 also discloses a similar zirconium-rich quinary alloy of zirconium (Zr), aluminum (Al), titanium (Ti), copper (Cu) and nickel (Ni).

It will be understood that the recitation of ranges contained herein are as a matter of convenience only and the inventors are in possession of every value intermediate within the ranges. That is, every intermediate value or sub-range within a disclosed range should be understood to be inherently disclosed. Further, every combination of the amorphous metal alloys disclosed herein are in the possession of the inventor and are not separately listed as a matter of convenience only.

Certain modifications and improvements will occur to those skilled in the art upon a reading of the foregoing description. It should be understood that all such modifications and improvements have been deleted herein for the sake of conciseness and readability but are properly within the spirit and scope of the claimed invention.

What is claimed is:

1. A string for a musical instrument, the string comprising an amorphous metal alloy consisting essentially of iron (Fe), chromium (Cr), manganese (Mn), molybdenum (Mo), carbon (C), yttrium (Y) and boron (B).

2. The string according to claim 1, wherein the amorphous metal alloy comprises the following atomic percentages:

| | |
|---|---|
| iron (Fe) | ≦40% |
| chromium (Cr) | <25% |
| manganese (Mn) | 15%-25% |
| molybdenum (Mo) | <25% |
| carbon (C) | 10%-25% |
| boron (B) | 10%-25% |
| yttrium (Y) | ≦4%. |

3. A string for a musical instrument having a fret board, the string comprising amorphous metal, wherein the string has a greater sustain of vibration than a string of identical dimension comprising a crystalline structure as measured by the ratio of the decay time of the fifth harmonic to the decay time of the fundamental frequency.

4. The string according to claim 3, wherein the ratio is greater than 0.55.

5. The string according to claim 3, wherein the amplitude of the second harmonic of the string is greater than the amplitude of the fundamental frequency of the string.

6. A musical instrument string comprising an amorphous metal alloy, wherein said amorphous metal alloy consists essentially of zirconium (Zr), titanium (Ti), nickel (Ni), copper (Cu), and beryllium (Be).

7. The string according to claim 6, wherein said amorphous metal alloy comprises the following atomic percentages:

| | |
|---|---|
| zirconium (Zr) | about 41.2 |
| titanium (Ti) | about 13.8 |
| nickel (Ni) | about 10 |
| copper (Cu) | about 12.5 |
| beryllium (Be) | about 22.5. |

8. A musical instrument string comprising an amorphous metal alloy, wherein said amorphous metal alloy consists essentially of zirconium (Zr), hafnium (Hf), aluminum (Al), nickel (Ni), copper (Cu), iron (Fe), cobalt (Co) and manganese (Mn).

9. The string according to claim 8, wherein said amorphous metal alloy comprises the following atomic percentages:

| | |
|---|---|
| zirconium (Zr) and hafnium (Hf) combined | about 25-about 85 |
| aluminum (Al) | about 5-about 35 |
| nickel (Ni), Copper (Cu), Iron (Fe), cobalt (Co) and manganese (Mn) combined | about 5-about 70. |

* * * * *